US005404716A

United States Patent [19]

Wells et al.

[11] Patent Number: 5,404,716

[45] Date of Patent: Apr. 11, 1995

[54] INTERNALLY INSULATED GAS MANIFOLD

[75] Inventors: Alan W. Wells, Edelstein; Michael H. Haselkorn; Robert L. Miller, both of Peoria, all of Ill.; Leslie C. Morris, West Lafayette, Ind.; Michael C. Long, Peoria Heights, Ill.

[73] Assignee: Caterpillar Inc., Peoria, Ill.

[21] Appl. No.: 201,933

[22] Filed: Feb. 24, 1994

[51] Int. Cl.[6] ..... F01N 3/20

[52] U.S. Cl. ..... 60/272; 60/323

[58] Field of Search ..... 60/322, 323, 272, 282; 123/195 R; 164/98

[56] References Cited

U.S. PATENT DOCUMENTS

| | | | |
|---|---|---|---|
| 3,413,803 | 12/1968 | Rosenlund | 60/282 |
| 3,488,723 | 1/1970 | Veazie | 60/323 |
| 3,709,772 | 1/1973 | Rice | 161/139 |
| 3,724,218 | 4/1973 | Cole | 60/323 |
| 3,864,908 | 2/1975 | Lahaye | 60/272 |
| 4,031,699 | 6/1977 | Suga | 60/282 |
| 4,644,915 | 2/1987 | Afshar | 123/142.5 R |
| 4,676,064 | 6/1987 | Narita et al. | 60/272 |
| 4,715,178 | 12/1987 | Tsukuda et al. | 60/272 |
| 5,052,463 | 10/1991 | Lechner et al. | 164/35 |
| 5,323,953 | 6/1994 | Adderley | 228/157 |

*Primary Examiner*—Ira S. Lazarus
*Assistant Examiner*—Daniel J. O'Connor
*Attorney, Agent, or Firm*—Frank L. Hart

[57] ABSTRACT

A manifold of an engine has a liner, a housing and an insulating element covering and extending about the liner between the liner and the housing. The external surface of the housing is free of insulating elements. The insulating element is quilted and has ceramic fiber encased within fiberglass.

18 Claims, 5 Drawing Sheets

INTERNALLY INSULATED GAS MANIFOLD

TECHNICAL FIELD

The present invention relates to a gas manifold of an engine and more particularly to an exhaust gas manifold of a turbocharged engine.

BACKGROUND ART

In the art of gas manifolds, particularly gas manifold of an exhaust gas manifold of an internal combustion engine, it is important that the manifold be sized to optimum values to correspond to the demand characteristics of the engine. With the advent of turbo charged engines, the exhaust gases were used for heating purposes.

In the operation of a diesel engine, particularly a turbo charged diesel engine utilized in marine environments, it is desirable that the outer surface of the manifold be maintained below recommended maximum temperatures and that exhaust gas and heat be retained during operation. Further, the manifold must be compact owing to the limited space available on most marine vessels. Further, it is desirable that the outer surface of the manifold be abrasive resistant and free from external insulating elements.

The present invention is directed to overcome one or more of the problems as set forth above.

DISCLOSURE OF THE INVENTION

In one aspect of the invention, an exhaust gas manifold of an engine has a liner, a housing and an insulating element. The liner has at least one inlet and an outlet. The housing has at least one inlet, an outlet, and an outer surface. The housing is generally mateable about the liner and define an annulus between the housing and liner. The outer surface of the housing is free of insulation. The insulating element is positioned about the liner within the annulus. The insulating element is quilted and has a ceramic fiber encased within fiberglass.

BEST MODE FOR CARRYING OUT THE INVENTION

Figure 1:
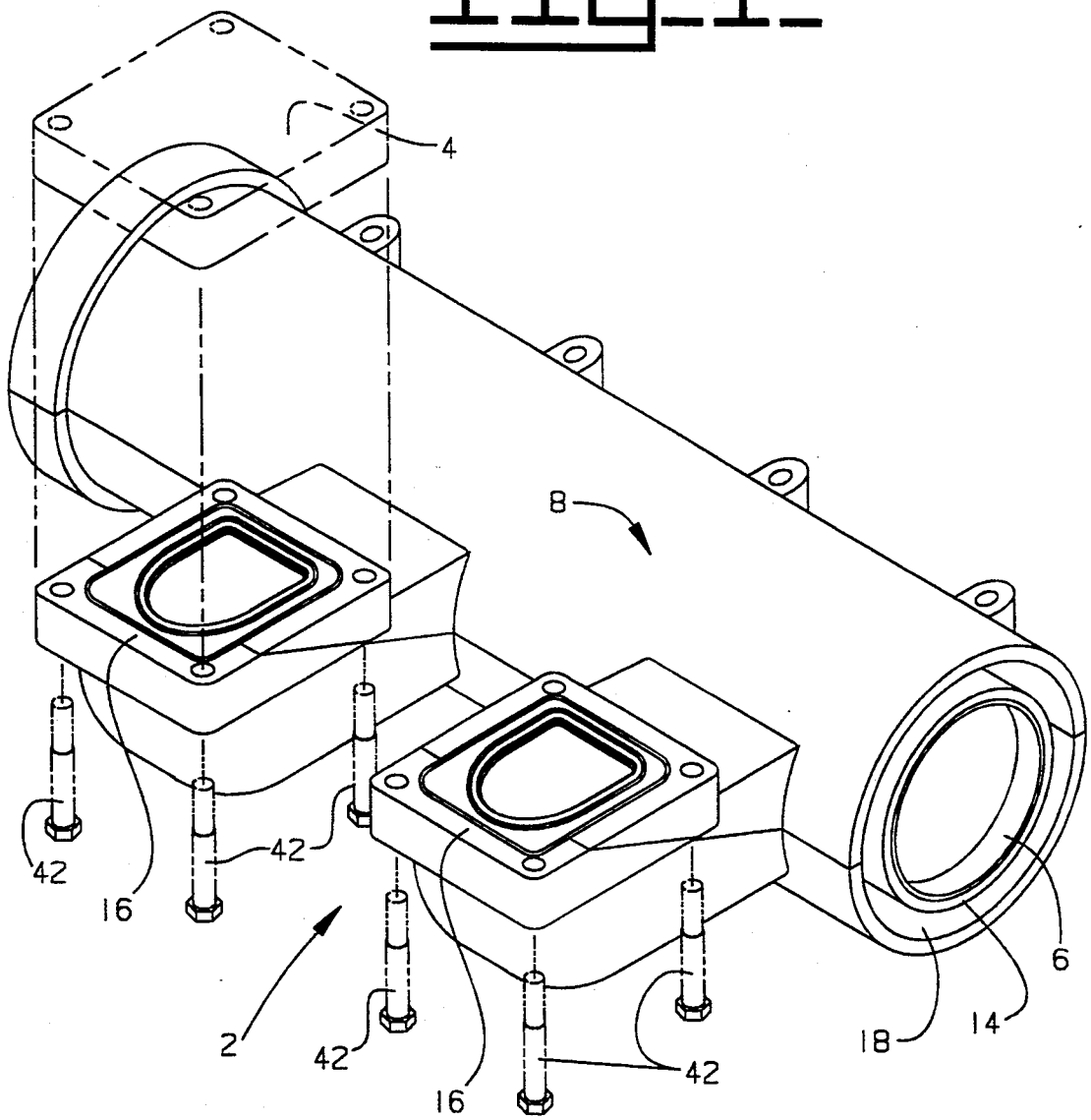
FIG. 1 ms a perspective view of the manifold of this invention.
Figure 2:
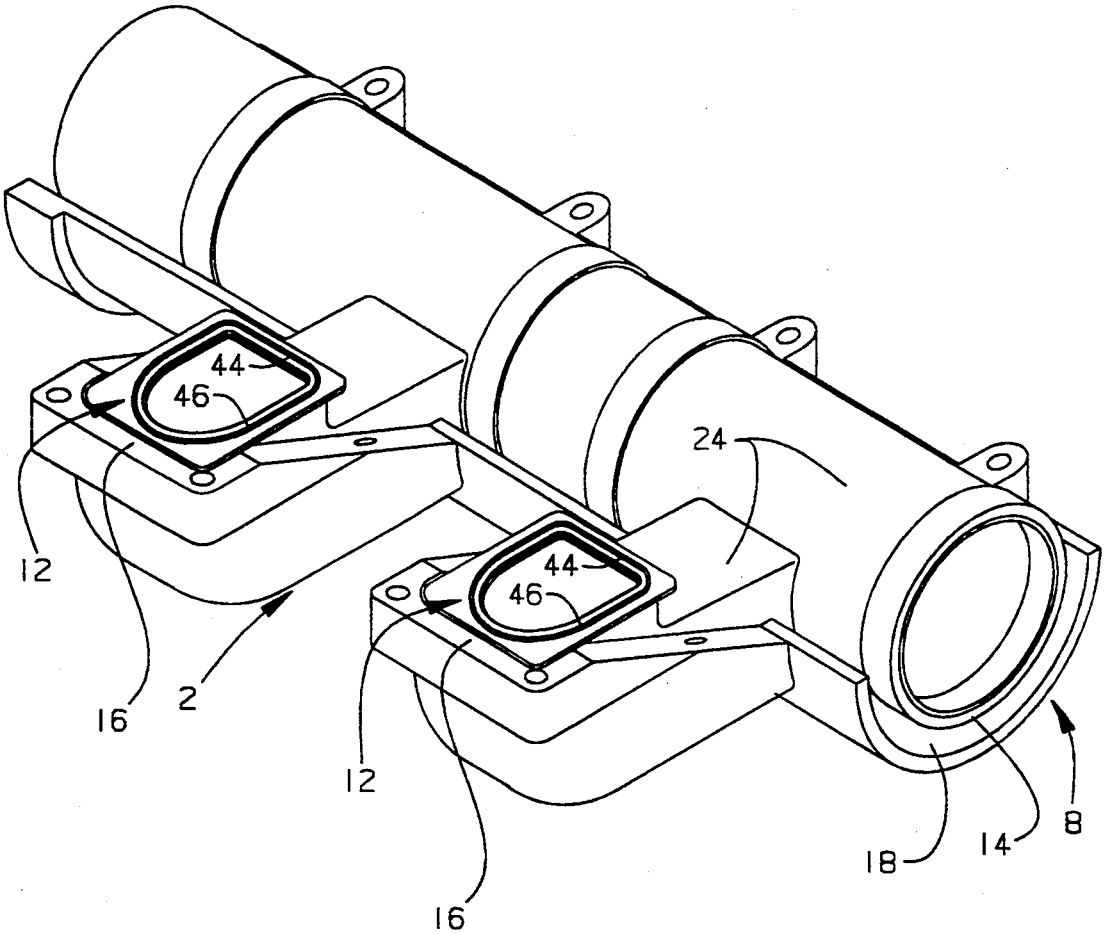
FIG. 2 ms a perspective view of the manifold with a portion of the housing removed.
Figure 3:
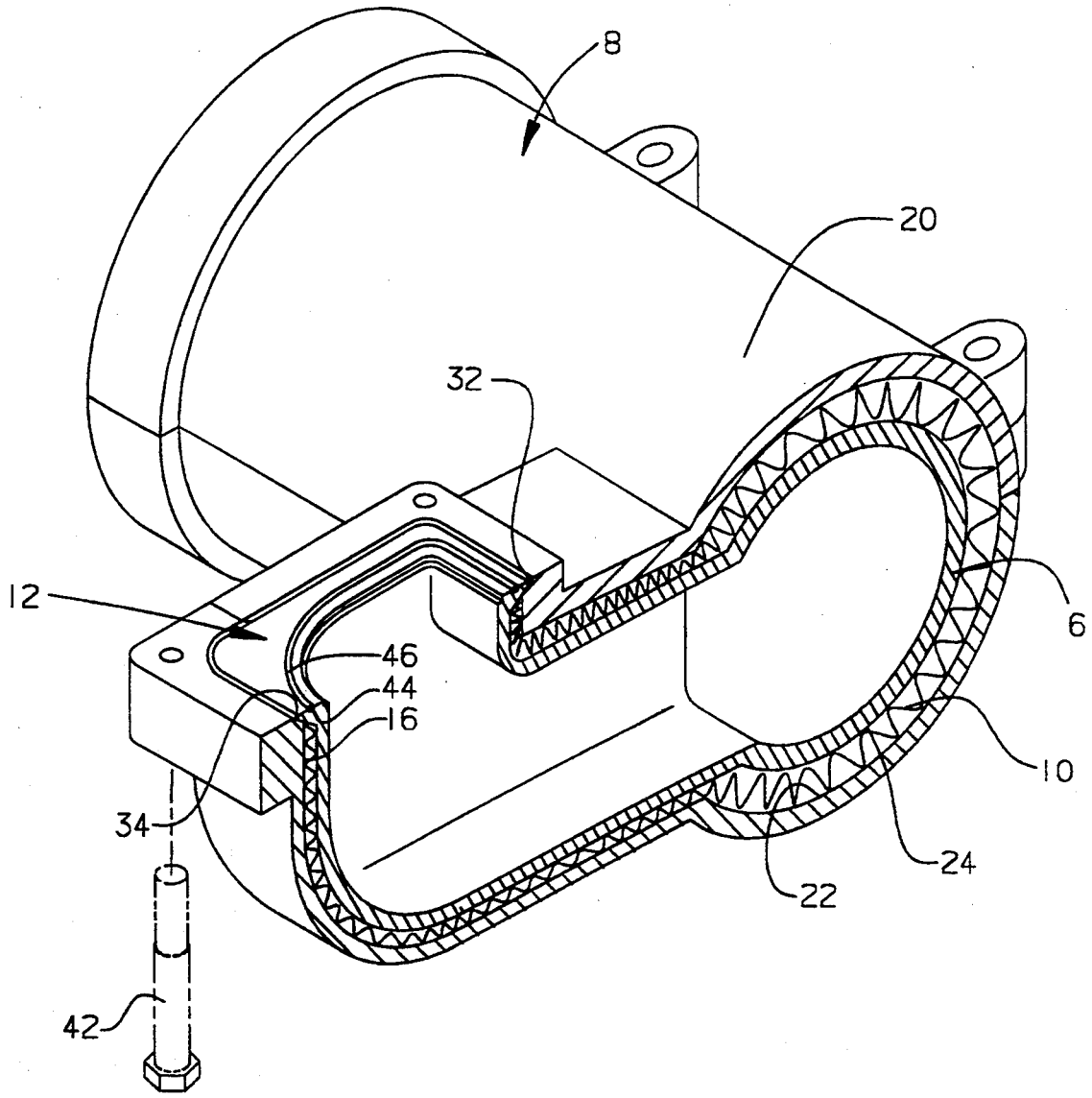
FIG. 3 ms a partial view of the manifold showing the liner within the housing.

Referring to FIGS. 1–3, a gas manifold 2 of an engine 4 has a liner 6, a housing 8, and an insulating element 10. The liner 6 has at least one inlet 12 and an outlet 14. The housing 8 has at least one inlet 16, an outlet 18, and a outer surface 20.

Referring to FIG. 3, the housing 16 is generally mateable with and about the liner 6 and defines an annulus 22 between the housing 8 and liner 6. The insulating element 10 is positioned about the liner 6 within the annulus 22. The liner 6 has an outer surface 24 and the insulating element 10 covers substantially the entire outer surface 24 of the liner 6. The insulating element 10 of this invention provides sufficient insulation to the maintain the outer surface 20 of the housing 8 at an acceptable temperature below about 400 degrees F. during operation of the engine 4. Therefore, the outer surface 20 of the housing 8 of the manifold 2 of this invention is free of insulation.

The insulating element 10 is quilted and has a ceramic fiber 26 encased within fiberglass 28. The ceramic fiber 26 of the insulating element 10 is one of alumino-silicate, mineral wool and refractory ceramic fibers, preferably alumino-silicate, and more preferably substantially shot free alumino-silicate. The insulating element can be contained in a metal foil to aid in assembly.

Figure 6:
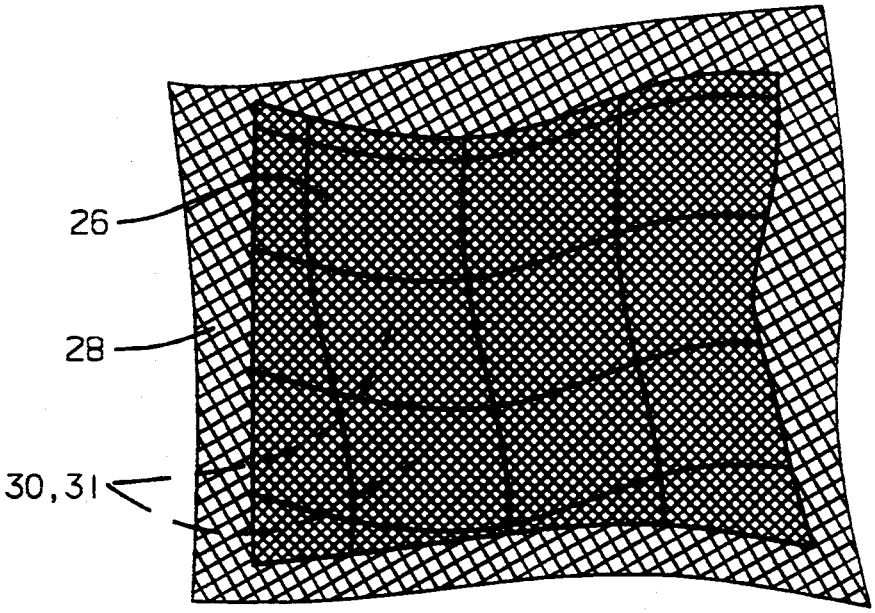
FIG. 6 is a diagrammatic view showing the fiberglass and ceramic fiber of the manifold.

Referring to FIG. 6, the quilting of the fiberglass 28 defines separate pockets 30,31 of ceramic fiber 26. The pockets 30,31 have pocket dimensions in the range of about 0.5 inches in length to about 10 inches in length and about 0.5 inches in width to about 10 inches in width. Preferably the dimensions of the pockets 30,31 are about 1 inch in length and about 1 inch in width.

Owing to the excellent insulating properties of the insulating element 10 of the construction of this invention, the insulating element 10 has a thickness in the range of about 0.25 inch to about 1 inch, more preferably about 0.325 inch, and at least having a thickness less than about 0.5 inch.

Figure 4:
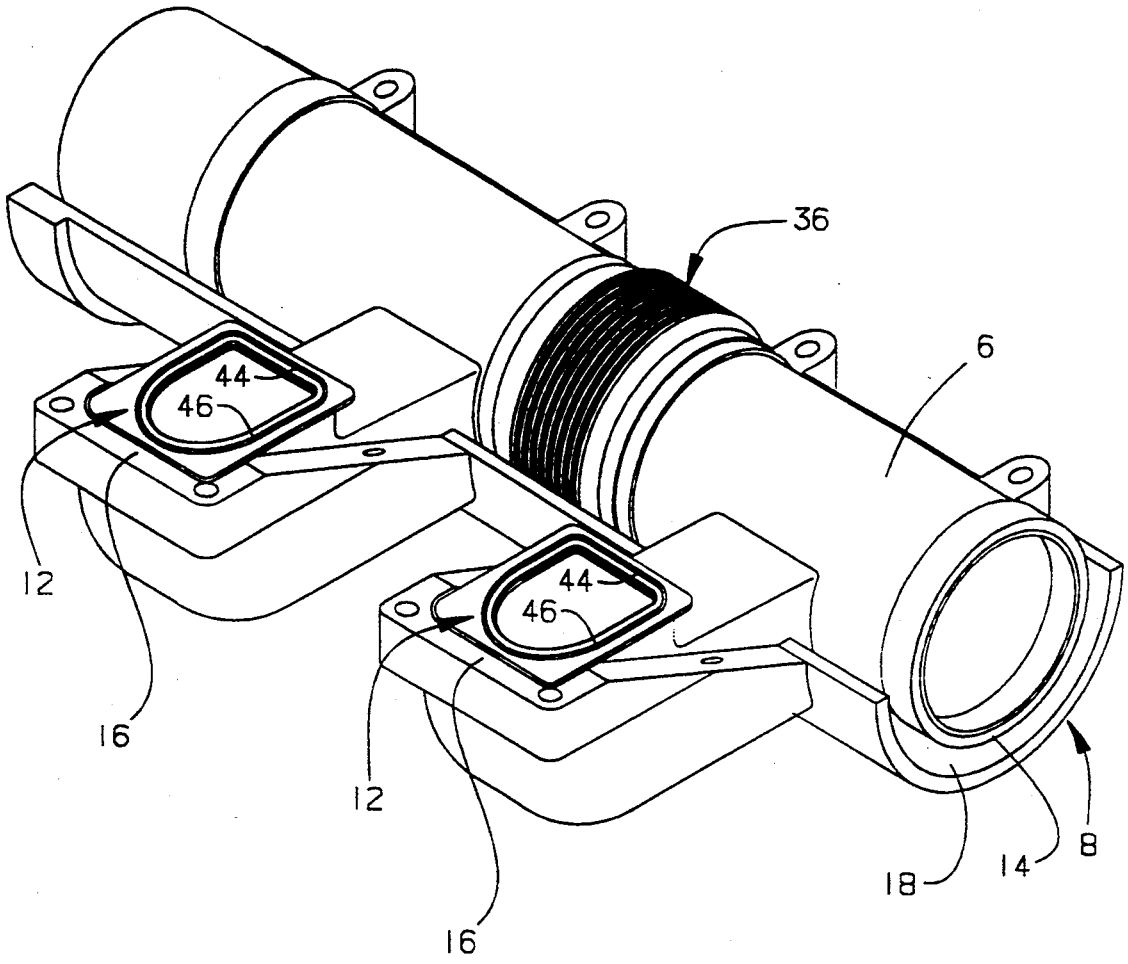
FIG. 4 ms a view of the bellows of the manifold.

Referring to FIG. 4, the liner 6 and housing 8 are formed of a plurality of mating pieces and includes bellows 36 extending about and covering the mating portions of the liner pieces. By this construction, a manifold 2 can be constructed to provide multiple gas inlets.

Figure 5:
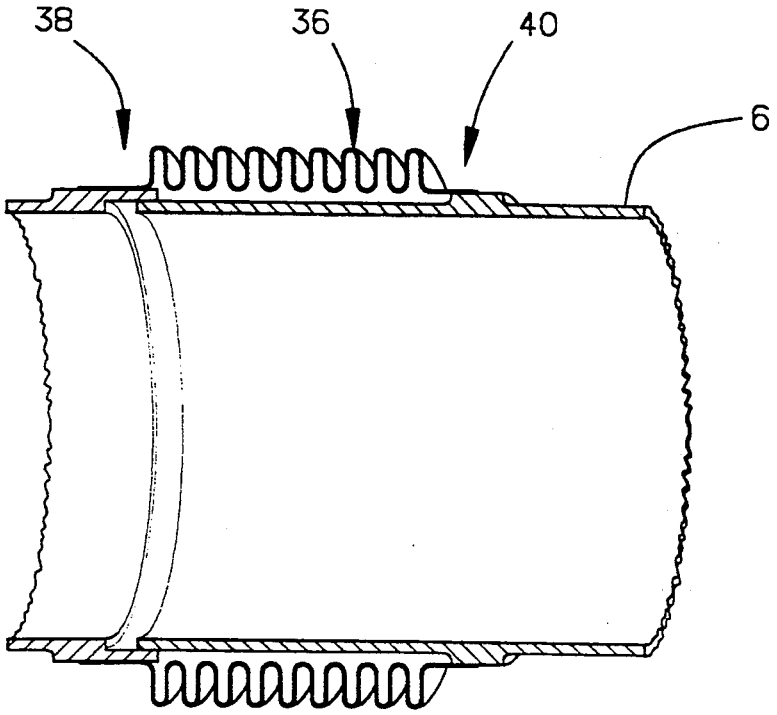
FIG. 5 ms an enlarged sectioned view of the bellows of the manifold.

Referring to FIG. 5, the mating pieces of the liner and housing are constructed to telescopically engage respective portions. The bellows 36 has first and second end portion 38,40, is formed of metal, and the first and second bellows end portions 38,40 are welded to and extend about respective telescopically engaged liner pieces. By this construction, the bellows 36 and their welds form expansion joints with gas tight seals between the liner pieces, which is most necessary for manifolds expected for marine usage.

Referring to FIG. 3, the liner inlet 12 and the housing inlet 16 each have mateable taper shoulders 32,34 contacting one another. In the installed position of the liner 6 within the housing 8, the liner inlet 12 extends outwardly from the housing inlet 16. Means such as bolts 42 are provided for connecting the manifold 2 to the engine.

The liner inlet 12 includes an annular groove 44 with a seal ring 46 disposed in the groove. The liner inlet 12 is of dimensions sufficient that at the installed position of the manifold 2 on the engine 4, the liner inlet portion is in forcible contact with the engine 4 and the housing inlet 16 is spaced from the engine 4.

The fiberglass 28 of the insulating element of this invention is preferably fiberglass cloth and more preferably is bidirectional fiberglass cloth as is well known in the art.

The liner 6 of this invention is formed of metal or ceramic material, preferably stainless steel. The housing 8 of this invention is preferably formed of metal, preferably cast iron. The housing 8 can be cast about a core formed of the liner 6 and the insulating element 10. Other materials suitable for the housing are aluminum and organic plastic. The liner 6 is preferably a thin walled vacuum cast liner.

The manifold of this invention is free from external insulating material or water cooling jackets, yet is capable of maintaining the temperature of the outer surface 20 of the housing 8 within acceptable temperatures during operation of the engine.

INDUSTRIAL APPLICABILITY

The manifold of this invention is of simple construction, compact, adapts itself to flexibility in construction and is solely internally insulated and thereby provides increased durability. The insulating element is thin and thereby conveniently adapts itself for use where engine space is severely limited, as for example in most marine applications. By providing a manifold having improved insulating characteristics, the manifold is particularly adapted for use in turbo charged engines where transfer of heat to the turbocharger improves efficiency.

Other aspects, objects and advantages of this invention can be obtained from a study of the drawings, the disclosure and the appended claims.

What is claimed is:

1. An exhaust gas manifold of an engine, comprising:

a liner having at least one inlet and an outlet;

a housing having at least one inlet, an outlet, and an outer surface and being generally mateable about the liner and defining an annulus between said housing and liner, said housing outer surface being free of insulation; and an insulating element positioned about the liner within the annulus, said insulating element being quilted and having ceramic fiber encased within fiberglass.

2. A manifold, as set forth in claim 1, wherein the liner has an outer surface and said insulating element covers substantially the entire outer surface of said liner.

3. A manifold, as set forth in claim 1, wherein the ceramic fiber of the insulating element is one of alumino-silicate, mineral wool and refractory ceramic fibers.

4. A manifold, as set forth in claim 1, wherein the ceramic fiber of the insulating element is substantially shot free alumino-silicate.

5. A manifold, as set forth in claim 1, wherein the fiberglass is quilted and defines a plurality of separate pockets of ceramic fiber having pocket dimensions in the range of about 0.5 inch in length to about 10 inches in length and about 0.5 inch in width to about 10 inches in width.

6. A manifold, as set forth in claim 5 wherein the pocket dimensions are about 1 inch in length and about 1 inch in width.

7. A manifold, as set forth in claim 1, wherein the insulating element has a thickness in the range of about 0.25 inch to about 1 inch.

8. A manifold, as set forth in claim 1, wherein the insulating element has a thickness less than about 0.5 inch.

9. A manifold, as set forth in claim 1, wherein the insulating element has a thickness of about 0.325 inch.

10. A manifold, as set forth in claim 1, wherein the insulating element liner and housing are of a construction sufficient to maintain the outer surface temperature of the housing at a temperature less than about 400 degrees F. during use of the manifold on an engine.

11. A manifold, as set forth in claim 1, wherein the housing and liner are formed of a plurality of mating pieces and including bellows extending about and covering the mating portions of the liner pieces.

12. A manifold, as set forth in claim 11, wherein a bellows has first and second ends, the mating pieces of the liner are constructed to telescopically engage one another, and the first and second bellows ends are each welded to a respective liner piece.

13. A manifold, as set forth in claim 12, wherein the bellows and bellows welds form a gas tight seal between the liner pieces.

14. A manifold, as set forth in claim 1, wherein the liner inlet and outer housing inlet each have mateable tapered shoulders and, in the installed position of the liner within the housing, said liner inlet extends outwardly from the housing inlet and including means associated with said housing inlet for connecting the manifold to the engine.

15. A manifold, as set forth in claim 14, wherein the liner inlet includes an annular groove and a seal ring disposed in the groove, a portion of the liner inlet is of dimensions sufficient that at the installed position of the manifold on the engine the liner inlet portion is in forcible contact with the engine and the inlet of the housing is spaced from said engine.

16. A manifold, as set forth in claim 1, wherein there are a plurality of liners, housings and insulating elements with one of each forming a manifold segment and with said manifold segments being connected together by bellows and defining a multiple inlet gas manifold.

17. A manifold, as set forth in claim 1, wherein the fiberglass of the insulating element is cloth.

18. A manifold, as set forth in claim 17, wherein the fiberglass cloth is of bidirectional woven cloth.

* * * * *